United States Patent [19]

Nassof

[11] Patent Number: 4,696,141

[45] Date of Patent: Sep. 29, 1987

[54] SUSPENDED CEILING HAVING A CONCEALED SUSPENSION GRID AND LAY-IN METAL PANELS SUPPORTED THEREON

[75] Inventor: Martin Nassof, Cliffside Park, N.J.

[73] Assignee: Simplex Ceiling Corp., Hoboken, N.J.

[21] Appl. No.: 875,944

[22] Filed: Jun. 19, 1986

[51] Int. Cl.[4] ..... E06B 3/54

[52] U.S. Cl. ..... 52/484; 52/145; 52/779

[58] Field of Search ..... 52/484, 485, 486, 763, 52/778, 779, 145

[56] References Cited

U.S. PATENT DOCUMENTS

| | | | |
|---|---|---|---|
| 1,929,751 | 10/1933 | Macdonnell | 52/145 |
| 3,267,626 | 8/1966 | Daly | 52/145 |
| 4,463,537 | 8/1984 | Rodriquez et al. | 52/484 X |

FOREIGN PATENT DOCUMENTS

| | | | |
|---|---|---|---|
| 46629 | 5/1977 | Australia | 52/779 |
| 684254 | 4/1964 | Canada | 52/485 |
| 1409938 | 10/1968 | Fed. Rep. of Germany | 52/779 |
| 395483 | 12/1965 | Switzerland | 52/484 |

*Primary Examiner*—William F. Pate, III
*Assistant Examiner*—Creighton Smith
*Attorney, Agent, or Firm*—Jacobs & Jacobs

[57] ABSTRACT

A suspended ceiling system for a room comprises a plurality of inverted T-shaped members suspended from the structural ceiling of the room and extending across the room, each T-shaped member having a horizontal base portion, and a plurality of open metal ceiling panels having opposed sides and ends and a bottom are supported by the inverted T-shaped members by means of a flange on one side wall of a panel resting on one side of the horizontal base portion while the other side of the horizontal base portion is received in slots in the end walls of the next adjacent panel.

4 Claims, 5 Drawing Figures

SUSPENDED CEILING HAVING A CONCEALED SUSPENSION GRID AND LAY-IN METAL PANELS SUPPORTED THEREON

The present invention relates to a suspended ceiling system based on the use of concealed, inverted T-shaped members that support open metal ceiling panels, and the open metal ceiling panels themselves.

Suspended ceiling systems are known in which open metal ceiling panels are supported by inverted T-shaped members, which are in turn suspended from the structural ceiling of the room. In this prior art suspended ceiling, the ceiling panels are placed on the horizontal base portions of the inverted T-shaped members, and hence these inverted T-shaped members are exposed. The present invention provides a "lay-in" suspended ceiling system in which the inverted T-shaped members are concealed and the joints between abutting metal panels are aligned.

The present invention also provides metal ceiling panels for use in the ceiling system.

In particular, the present invention provides a suspended ceiling system for a room, which comprises a plurality of inverted T-shaped members suspended from the structural ceiling of the room and extending across the room, each T-shaped member having a horizontal base portion. A plurality of open metal ceiling panels are also provided, having opposed first and second side walls, opposed first and second end walls and a bottom wall, the first side wall of the panel having a flange projecting therefrom in a direction away from the second side wall, the flange being parallel to and spaced from the bottom wall.

The end walls of panel have first and second ends adjacent the first and second side walls, respectively, the end walls having a lower portion integral with the bottom wall and an upper portion spaced from the lower portion at the end wall second end to define an open slot in each end wall parallel to and spaced from said bottom wall. The opening of each slot faces the second side wall and the upper portion of the end wall is set back from the lower portion at each end wall second end.

The panels are supported by the inverted T-shaped members with the flange of one panel resting on and supported by one side of the horizontal base portion of a T-shaped member while the other side of the horizontal base portion is received in the slots of the end walls of an adjacent abutting panel. The joints between adjacent panels are aligned due to the cooperation between the panels and the T-shaped members.

The present invention is illustrated in terms of preferred embodiments in the accompanying drawings, wherein.

Figure 1:
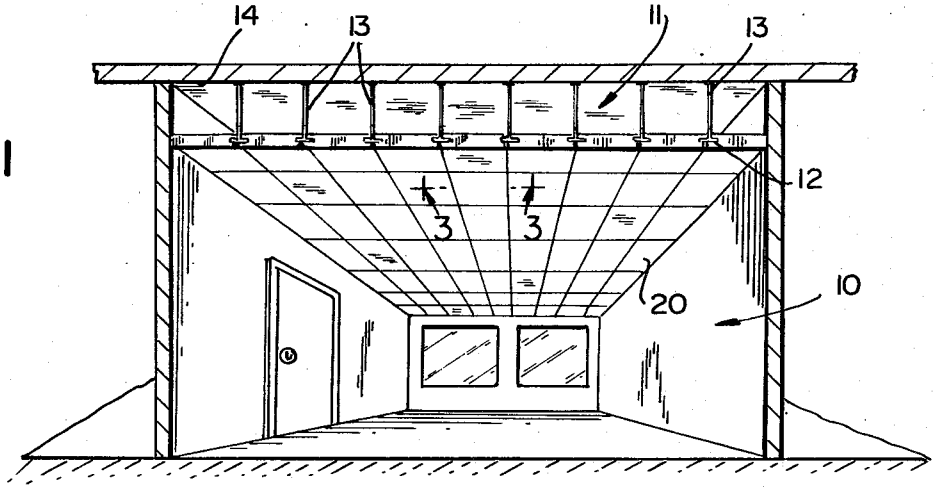
FIG. 1 is a perspective view of a room with a suspended ceiling according to the present invention.

With reference to FIG. 1, room 10 is provided with a suspended ceiling 11 that extends substantially from wall-to-wall and end-to-end of the room. The suspended ceiling 11 is provided with concealed, conventional inverted T-shaped members 12 that run longitudinally across the room, which are themselves carried by wires 13 that are hung from the structural ceiling 14, all in a manner known per se. Panels 20 are supported on the T-shaped members 12 in the manner described below.

Figure 2:
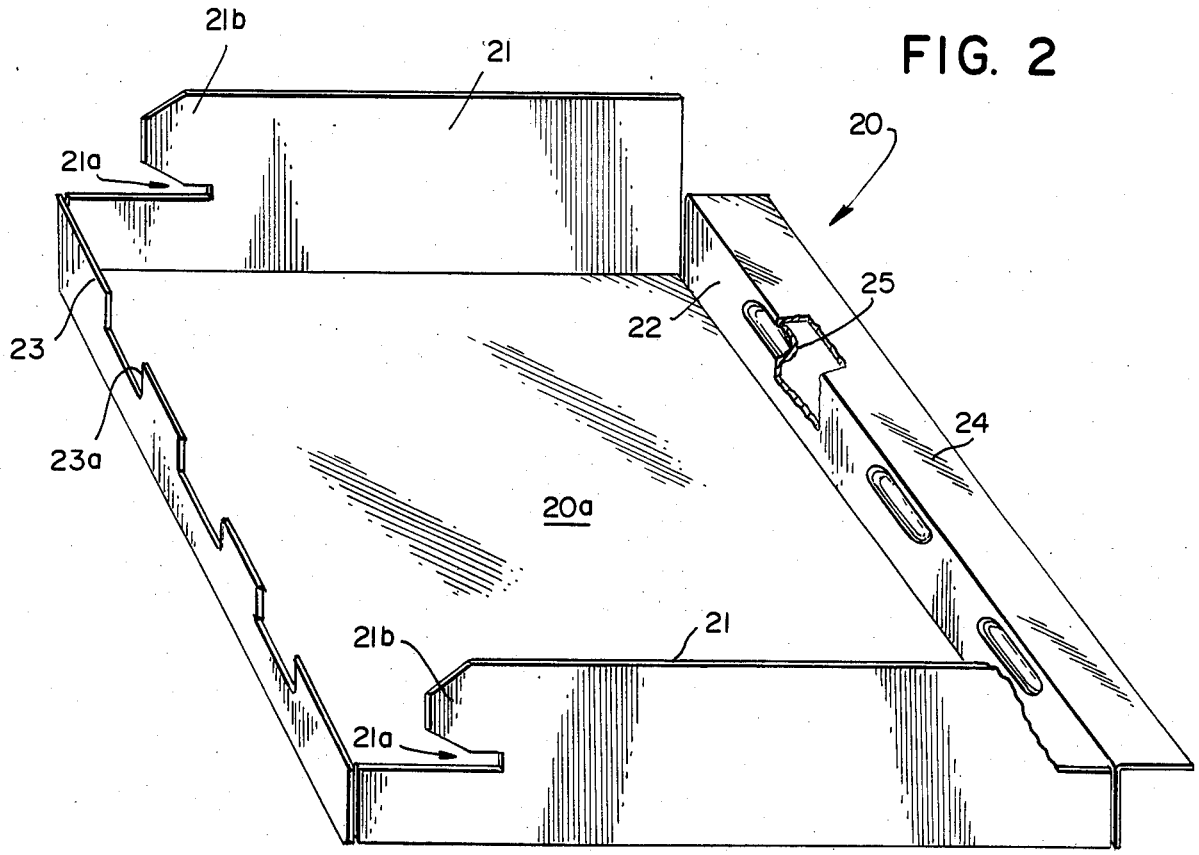
FIG. 2 is a perspective view of a metal ceiling panel used in the present invention.

FIG. 2 shows a metal ceiling panel 20 having opposed end walls 21, 21 opposed side walls, 22, 23 and bottom wall 20*a*. Metal ceiling panel 20 may be made from any suitable material, such as galvanized steel or aluminum. Metal ceiling panels 20 may be square or rectangular in shape and of any suitable size, and it is presently preferred to use square panels 20 that are one foot or two feet square.

As seen in FIG. 2, end walls 21 are each provided with an open slot 21*a*. Side wall 22 has flange 24 projecting away therefrom and detents 25 projecting outwardly of panel 20. The other side wall 23 is provided with apertures or notches 23*a*. While FIG. 2 shows three detents 25 and three notches 23*a*, the precise number and/or spacing of the detents 25 is not critical.

Figure 3:
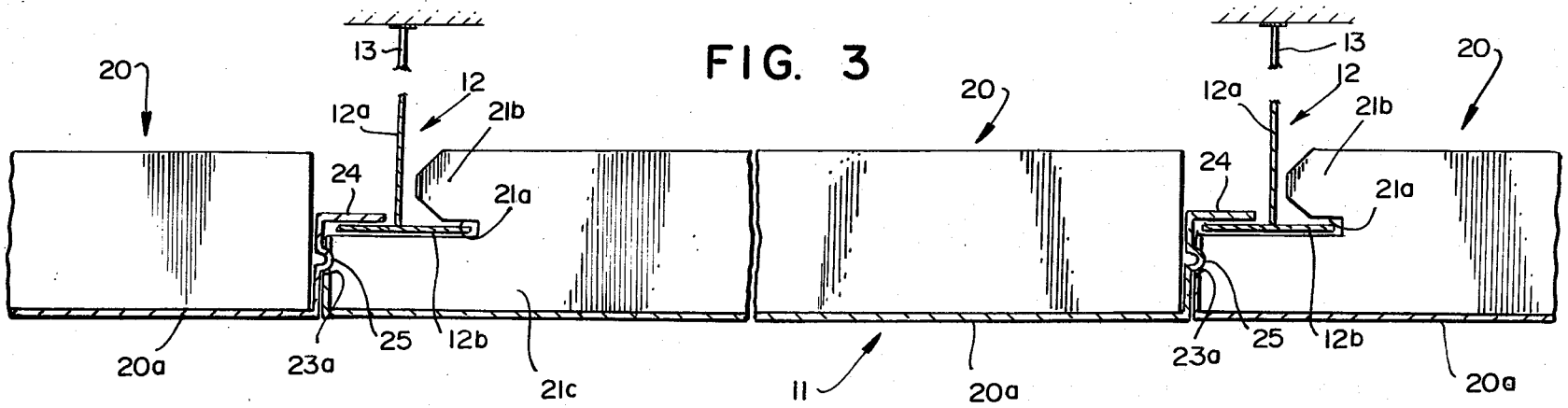
FIG. 3 is a view in section taken along lines 3—3 in FIG. 1.

FIG. 3 shows the panels 20 in their installed position to form ceiling 11. As seen in FIG. 3, the detents 25 of one panel 20 extend into the notches 23*a* of the next adjacent panel 20. Further, the flange 24 of one panel 20 rests on one side of the base portion 12*b* of the T-shaped member 12, while the other side of base portion 12*b* is received in slot 21*a* of the adjacent panel 20, with the end portion 21*b* (FIG. 3) of side 21 resting on base 12*b*. In this manner, the T-shaped members 12 provide a concealed support for panels 20. It will be noted that the upper end portion 21*b* is spaced from the lower portion 21*c* of end wall 21 to form slot 21*a*. Upper end portion 21*b* is also set back from the lower portion 21*c* to allow one side of the base portion 12*b* to enter slot 21*a* while the other side is adjacent the left hand end (as viewed in FIG. 3) of the lower portion 21*c*.

Panels 20 are formed by conventional stamping and bending operations, which do not always produce a panel 20 where the end walls 21 and side walls 22, 23 are perfectly square with respect to bottom wall 24. Further, the lines joining end walls 21 and side walls 22, 23 are not always perfectly straight. In a ceiling formed of a large number of panels 20, this means that there will be many misaligned joints between adjacent panels 20, which cannot be hidden by the T-shaped member 12 as they would be in a conventional exposed T-grid system.

Panels 20 overcome this problem through flanges 24 and slots 21*a*, which are parallel to and spaced from bottom wall 24 by a predetermined distance, which thereby establishes a predetermined, fixed reference point for panels 20 with respect to the T-shaped members 12. Thus, since flange 24 rests on one side of a base portion 12*b* and since notch 21*a* receives the other side of the base portion 12*b*, the distance between the bottom walls 20*a* of abutting panels at the joint between them is controlled and is kept constant, thereby aligning the bottom walls 20*a* of and hence the joint between adjacent abutting panels 20. Further, the more rigid base member 12*b* acts as a rigidifier and straightener for the less rigid side walls 22, 23, which also results in more perfect alignment of the joints. Detents 25 (FIG.2) or 25′ (FIG. 4A) and notches 23*a* are preferably also included to provide indexing of the panels 20 with respect to end walls 21, and thus provide further alignment of the joints between abutting panels 20.

Figure 4A:
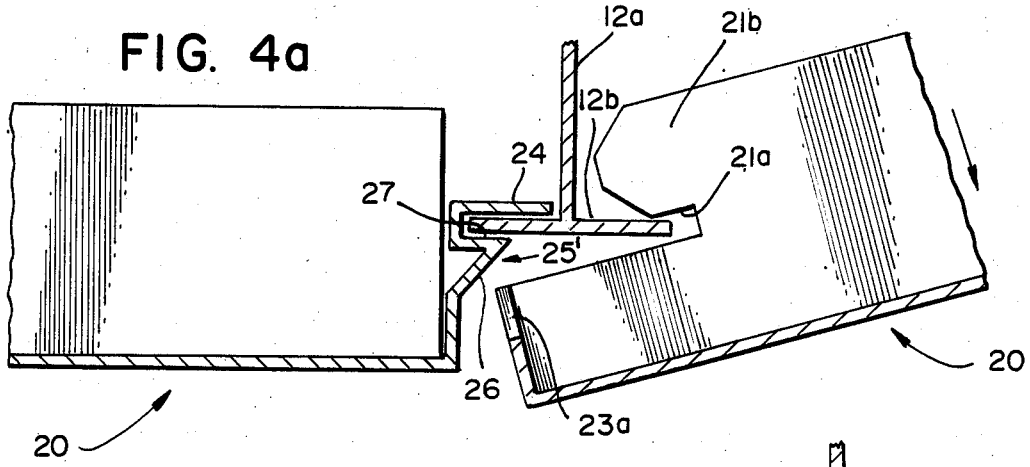
FIGS. 4A and 4B are detail views, in section, showing the steps used in installing the panels, and illustrating an alternative embodiment of the invention.
Figure 4B:
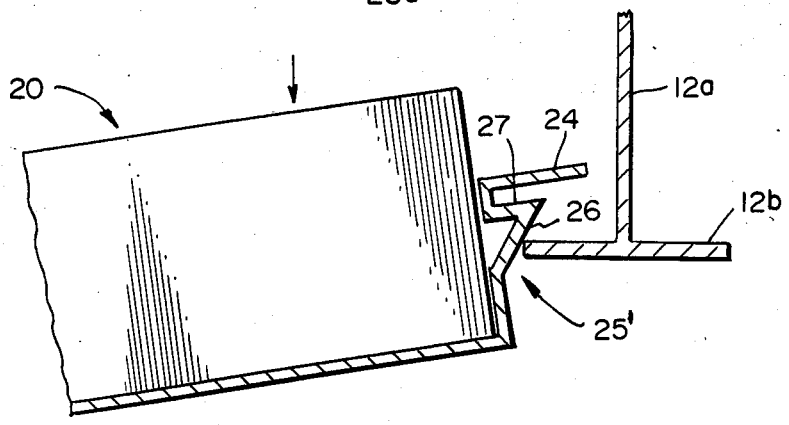

An alternative embodiment of the invention is illustrated in FIGS. 4A and 4B, which also illustrate the assembly of panels 20 to the T-shaped members 12. FIG. 4A depicts the left-hand panel 20 of FIG. 3 already in place, and shows only the right-hand side of the middle panel of FIG. 3. In FIGS. 4A and 4B, the middle panel is in the position just prior to being snapped in place. Thus, as viewed in FIG. 4A, the left-hand end of the middle panel 20 is moved to the left toward the T-shaped member 12 and the right-hand end (FIG. 4B) is swung down, whereby one side of the base portion **12*b* enters the mouth of slot 21*a* (FIG. 4A) and detent 25' contacts the next adjacent T-shaped member 12 (FIG. 4B). As seen in FIG. 4B, the detent 25' has a lower inclined planar cam surface 26 and an upper planar stop surface 27 that is perpendicular to side wall 22, whereas detent 25 (FIG.2) has upper and lower curved surfaces that are substantially semi-circular in cross-section taken perpendicular to the end wall 21 and bottom wall 20*a***.

Whether panel 20 has detent 25 or 25', it will be snapped into the position shown in FIG. 3 by pushing side wall 22 downwardly as shown by the arrow in FIG. 4B. The lower portion of detent 25 or 25' will ride along the edge of base portion **12*b* as panel 20 moves downwardly, and T-shaped member 12 will be pushed slightly to the right as seen in FIG. 4B until the lower portion of the detent 25 or 25' clears the base portion 12*b*. For example, with reference to FIG. 4B, T-shaped member 12 moves to the right until cam surface 26 passes below base portion 12*b*. Downward movement of panel 20 is arrested when flange 24 contacts base portion 12*b* and the panel 20 is then in the installed position shown in FIG. 3**.

Panels 20 can be provided with detents 25 or 25', the difference being that the detent 25 is curved on its upper and lower portions and hence allows the panel to be removed by ushing upwardly on panel 20, whereas detent 25' has stop surface 27 that prevents panel 20 from moving upwardly, thereby locking panel 20 in place and preventing its removal.

T-shaped members 12 are pushed only slightly to the right by the detents 25, 25'. For example, for panels that are two-feet square with detents 25 or 25' projecting $\frac{1}{4}$ inch away from end wall 22, T-shaped members 12 will be displaced by at most $\frac{1}{4}$ inch. The members 12 readily return to their original vertical position after panel 20 is snapped in place, since the members 12 are suspended by wires 13 and hence seek the vertical position. Any slight deviation from the vertical will be corrected when the next adjacent panel 20 to the right is installed.

Ceiling 11 can be installed either by installing panels 20 side-by-side with the sides 22, 23 abutting or end-to-end with the end 21 of one panel abutting the end 21 of the next adjacent panel, or a combination thereof. It may be desirable to provide the last panels to be installed with a knob (not shown) that is removably attached to the panel, as by a sheet metal screw, which may be removed after the panel is snapped into place. It is also desirable to secure L-shaped members (not shown) to the walls parallel to the T-shaped members, as is known, to support the free ends of the panels adjacent to the walls.

Panels 20 may be empty or filled with acoustical insulation and the bottom wall 24 may be perforated or unperforated. For a two-foot square panel 20, suitable results have been obtained using three detents 25, 25' that are $\frac{1}{2}$ inch long and that project $\frac{1}{4}$ inch, with notches **23*a* being sized to receive the detents. Flange 25 may be $\frac{3}{8}$ inch wide and notch 21*a* will be deep enough to receive the base member 12*b***.

We claim:

1. A suspended ceiling system for a room, which comprises a plurality of inverted T-shaped members suspended from the structural ceiling of the room and extending across the room; each said T-shaped member having a horizontal base portion;

a plurality of open metal ceiling panels having opposed first and second side walls, opposed first and second end walls and a bottom wall;

said first side wall of a said panel having a flange projecting therefrom in a direction away from said second side wall, said flange being parallel to and spaced from said bottom wall;

said end walls of a said panel having first and second ends adjacent said first and second side walls, respectively, said end walls having a lower portion integral with said bottom wall and an upper portion spaced from said lower portion at said end wall second end to define an open slot in each said end wall parallel to and spaced from said bottom wall, the opening of each said slot facing said second side wall, said upper portion being set back from said lower portion at each end wall second end;

said panels being supported by said inverted T-shaped members with the flange of a said panel resting on and supported by one side of the horizontal base portion of a said T-shaped member while the other side of said horizontal base portion is received in the slots of the end walls of an adjacent abutting panel; and said first side wall of a said panel having a plurality of longitudinally spaced apart detents formed therein and projecting in a direction away from said first side wall and said second side wall having a plurality of open notches therein spaced apart such that the detents of a said panel will be received in the notches of an adjacent abutting panel, and wherein said detents have upper and lower portions relative to said bottom wall, said upper portion being planar and substantially perpendicular to said first side wall; whereby the joints between adjacent panels are aligned.

2. The ceiling system according to claim 1, wherein said lower portion of a said detent is planar and projects upwardly away from said second side wall ot said upper portion.

3. A metal ceiling panel for use in a suspended ceiling system, which comprises opposed first and second side walls, opposed first and second end walls and a bottom wall; said first side wall having a flange projecting therefrom in a direction away from said second side wall, said flange being parallel to and spaced from said bottom wall; said end walls having first and second ends adjacent said first and second side walls, respectively, said end walls having a lower portion integral with said bottom wall and an upper portion spaced from said lower portion at said end wall second end to define an open slot in each said end wall parallel to and spaced from said bottom wall, the opening of each said slot facing said second side wall, said upper portion being set back from said lower portion at each said end wall second end; said first side wall having a plurality of longitudinally spaced apart detents formed therein and projecting in a direction away from said first side wall and said second side wall having a plurality of open notches therein spaced apart such that the detents of another said panel will be received in the notches when adjacent to and abutting said panel; and said detents having upper and lower portions relative to said bottom wall, said upper portion being planar and substantially perpendicular to aid first side wall.

4. The ceiling system according to claim 3, wherein said lower portion of a said detent is planar and projects upwardly away from said second side wall to said upper portion.

* * * * *